United States Patent [19]

Eichner

[11] 4,370,821

[45] Feb. 1, 1983

[54] ROTARY MAGAZINE ASSEMBLY FOR HOLDING INFORMATION BEARING CARDS

[75] Inventor: Falk J. Eichner, Coburg, Fed. Rep. of Germany

[73] Assignee: Eichner Organization KG, Coburg, Fed. Rep. of Germany

[21] Appl. No.: 256,654

[22] Filed: Apr. 22, 1981

[30] Foreign Application Priority Data

Apr. 26, 1980 [DE] Fed. Rep. of Germany ..... 3016190

[51] Int. Cl.[3] ..... G09F 11/02

[52] U.S. Cl. ..... 40/497; 40/372

[58] Field of Search ..... 40/372, 497

[56] References Cited

U.S. PATENT DOCUMENTS

| | | | |
|---|---|---|---|
| 447,815 | 3/1891 | Frecks | 40/497 |
| 1,049,886 | 1/1913 | Manson | 40/497 |
| 1,476,157 | 12/1923 | Fleming | 40/372 |
| 3,261,649 | 7/1966 | Erickson | 40/372 |
| 4,204,351 | 5/1980 | Hawkins | 40/372 |

*Primary Examiner*—Gene Mancene
*Assistant Examiner*—Wenceslao J. Contreras
*Attorney, Agent, or Firm*—Watson, Cole, Grindle & Watson

[57] ABSTRACT

A rotary magazine assembly for holding information bearing cards and the like having support pins attached along one of the sides of the cards, includes a stand with spaced apart plates for supporting the cards for rotary movement about the central axis of the stand, and a device mounted on the stand adjacent one of the plates for maintaining a pair of cards separated from one another when it is desired to retrieve information therefrom, the device including a stop element moveable into and out of engagements with sides of the separated cards.

2 Claims, 2 Drawing Figures

ROTARY MAGAZINE ASSEMBLY FOR HOLDING INFORMATION BEARING CARDS

RELATED APPLICATION

This application relates to U.S. Ser. No. 256,520 filed Apr. 22, 1981, commonly owned herewith and entitled Magazine Assembly For Holding Information Bearing Cards and the Like.

BACKGROUND OF THE INVENTION

This invention relates to a rotary magazine assembly of the type having a plurality of card support pins pivotally mounted thereon, the pins being attached along sides of the cards which bear information and/or pockets for receiving information to be retrieved.

Magazine assemblies of the general type with which the present invention is concerned facilitate the retrieval of information from the cards as they are separated from one another upon pivotal movement about the axis of their support pins. Such assemblies usually include a stand on which the support pins are mounted for rotary movement about the central axis of the stand. However, once a pair of cards are separated to retrieve information from a selected one of them, they must be maintained separated by a hand of the operator or by some object. This is not only cumbersome but also inconvenient especially if both hands of the operator are needed to perform a simultaneous task.

SUMMARY OF THE INVENTION

It is therefore an object of the present invention to provide a rotary magazine assembly of the general class described wherein a device is mounted on the stand for maintaining the cards separated from one another, such a device including a stop element moveable into and out of engagement with a selected side of one of the separated cards, and thus functioning in the manner of a bookmark.

Another object of this invention is to provide such an assembly wherein the device includes a slideable guide-pin to which the stop element is attached.

A further object of the present invention is to provide such an assembly wherein the device includes a support arm which engages the stand, a hollow bushing being secured to the arm through which the guide pin extends, and the stop element being attached to one end of the guide pin with a finger gripping element attached to an opposite end of the pin to facilitate manual movement of the stop element.

A still further object of this invention is to provide such an assembly wherein the support arm is rotably mounted on the stand, and the stop element has a curved outer end for engagement with edges of the cards upon rotation thereof about the central axis of the stand when the stop element is moved out of engagement with a side of one of the separated cards.

Other objects, advantages and novel features of the invention will become more apparent from the following detailed description of the invention when taken in conjunction with the accompanying drawings.

DETAILED DESCRIPTION OF THE INVENTION

Figure 1:
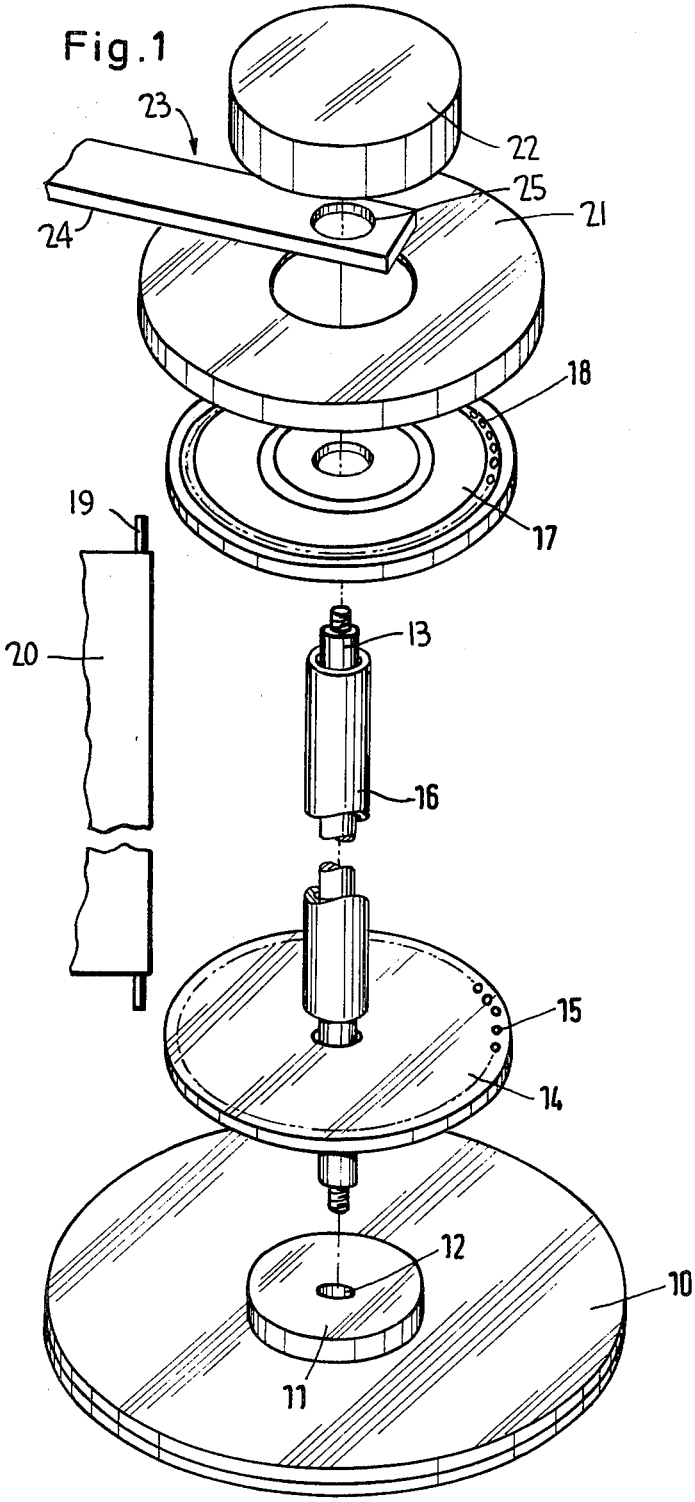
FIG. 1 is an upright, expanded and perspective view of the rotary magazine assembly according to the invention.

Turning now to the drawings wherein like reference characters refer to like and corresponding parts throughout the several views, the rotary magazine assembly shown in FIG. 1 includes a base plate 10 having a centrally located bushing 11 with an internally threaded central base 12. An elongated axle 13 having an externally threaded lower end is threadedly engaged with base 12, and forms a stand together with base 10. A lower disc or plate 14 has a central opening through which axle 13 extends, the plate bearing against bushing 11 and having a plurality of openings 15 therein spaced inwardly along its outer periphery. A casing 16 loosely surrounds axle 13 and is rotatable relative thereto. Means (not shown) may be provided on plate 14 for securing the plate to the casing. An upper disc or plate 17 may have a depending central sleeve (not shown) similar to that disclosed in the aforementioned related application, to facilitate attachment to casing 16 so that the upper and lower plates and the casing are rotatable together as a unit about the central axis of axle 13.

Upper plate 17 is provided with a plurality of openings 18 which are opposed to and are arranged similarly to openings 15 in the lower plate. These opposed openings receive the opposite ends of support pins 19 which are attached along the sides of information bearing cards 20 (only one of such pins and cards being illustrated in FIG. 1). As typical for this type of assembly, the support pins together with their attached cards are capable of rotary of pivotal movement about the axes of the pins and are capable of rotary movement about the central axis of the axle 13 together with the rotary movement of the plates 14, 17 and casing 16.

A cover plate 21 overlies upper plate 17 for closing openings 18, and a closure plate 22 overlies plate 21 and has a central internally threaded bore (not shown) which engages the threaded upper end of the axle.

The device according to the invention for maintaining a selected card separated from an adjacent card, is generally designated 23 and is mounted on axle 13. Device 23 includes a support arm 24 having one or more openings 25 therein through which axle 13 extends. Arm 24 may be disposed between plates 21 and 22 as shown, between plates 17 and 21, or between plate 14 or bushing 11, without departing from the invention.

Figure 2:
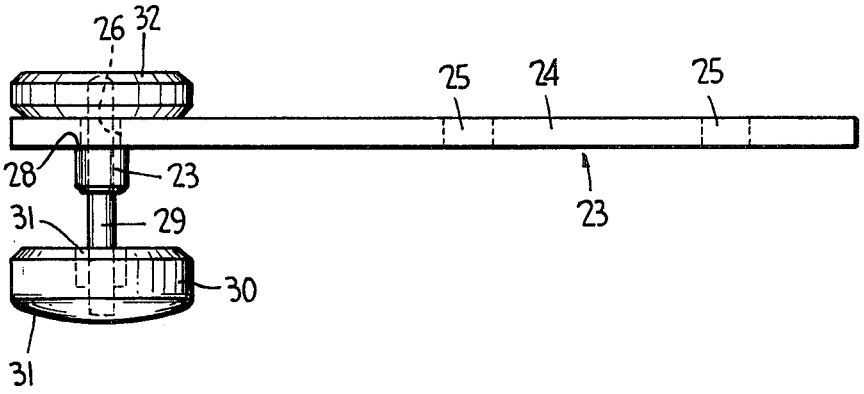
FIG. 2 is a side elevational view of the device according to the part of invention utilized in combination with the FIG. 1 assembly for maintaining cards spearated from one another.

As seen in more detail in FIG. 2, support arm 24 has an opening 26 adjacent the outer terminal and thereof, and a hollow bushing 27 frictionally engages opening 26 and has an enlarged outer portion defining an annular stop shoulder for limiting the extent of the bushing within opening 26. A guide pin 29 extends through the hollow bushing and is slideable relative thereto along the central axis of the pin. A circular stop element 30, which may alternatively be flat, is frictionally mounted at the lower end of the guide pin, and has an enlarged central opening 31 surrounding the guide pin for the reception of the enlarged outer portion of the bushing when the stop element is moved into an upper position lying flatly against the underside of arm 24. A finger element 32, in the form of a disc or the like, is frictionally mounted on the upper opposite end of the guide pin to facilitate manual shifting movement of stop element 30 between its lower position shown in FIG. 2 and its upper position abutting against the underside of arm 24. And, the outer end of stop element 30 is curved as at 33 for serially striking against the upper edges of the cards, when stop element 30 is moved to its upper position, without interferring with the rotary movement of the cards about the central axis of the stand.

Depending on the width of the cards, arm 24 is mounted in place with axle 13 extending through one of its openings 25. The arm may be rotatably mounted in place to facilitate rotation of device 23 relative to the stand. Also, stop element 30 is shown in FIG. 2 as depending from arm 24 which may be mounted above the cards. Certainly, if device 23 is mounted below the cards, stop element will extend upwardly from support arm 24. In either case, element 30 should have an outward extend from arm 24 sufficient to bear against selected side surfaces of a pair of the separated cards. And, element 30 should have an extent toward the cards from arm 24 such that its outer curve end engages the edges of the cards which lie perpendicular to ends 19, without interfering with the smooth rotation of the cards about the central axis of the stand.

In operation, with element 30 lying inwardly against arm 24, cards 20 may be rotated about the central axis of the stand as the curved outer end of element 30 serially engages the edges of the cards. Then, when a selected card is reached, it is maintained spaced apart from its adjacent card by simply pushing inwardly on finger gripping element 32 so as to extend stop element 30 away from arm 24 and into engagement with the sides of the adjacent selected cards. The information thereon may thus be retrieved without manually holding the cards spaced apart, or without the need to prop a book or some other object thereagainst for keeping them spaced apart. Thereafter, element 32 is manually moved away from arm 24 to correspondingly move element 30 toward the support arm to permit the cards to again be rotated about the central axis of the stand.

Obviously, many other modifications and variations of the present invention are made possible in the light of the above teachings. For example, stop element 30 may be mounted for pivotal movement toward and away from its support arm 24. It is therefore to be understood that within the scope of the appended claims the invention may be practiced otherwise than as specifically described.

What is claimed:

1. A rotary magazine assembly for holding information bearing cards and the like having support pins attached along one of the sides of the cards, comprising, a vertical axle having a support base, a pair of spaced plates rotatably mounted on said axle, an upper disc having a central aperture overlying an upper one of said plates, said plates each having opposed openings therein, opposite ends of said support pins pivotally engaging said opposed openings to permit pivotal movement and separation of the cards about the axes of said pins, said plates and said pins, together with the cards, thereby being rotatable about the central axis of said axle, a device comprising a horizontally disposed support arm mounted on said axle above said disc for rotation about said central axis, said device further comprising a vertically disposed guide pin overlying the cards and extending through an opening in said arm for vertical sliding movement, a stop element attached to one end of said pin and being spaced from said arm while extending in one position under gravity into a selected space between a pair of the cards when separated, and said device further comprising a finger gripping element attached to an opposite end of said pin for maintaining said stop element in said one position, whereby said device maintains the pair of cards separated and arrests the rotary movement about said central axis when it is desired to retrieve information therefrom with said stop element in said one position, said stop element being moved into a second raised position upon elevation of said finger gripping element to permit the cards to again be rotated about said central axis.

2. The rotary magazine assembly according to claim 1, wherein said stop element has a curved outer end for engagement with edges of the cards upon rotation of the cards about said central axis when said stop element is moved into said second position.

* * * * *